United States Patent [19]

Eirich et al.

[11] Patent Number: 4,560,283

[45] Date of Patent: Dec. 24, 1985

[54] APPARATUS FOR CLOSING AND CONTINUOUSLY EMPTYING THE CONTAINER OF A TREATMENT MACHINE

[75] Inventors: Paul Eirich, Bahnhofstr. 11; Hubert Eirich, Sandweg 1; Walter Eirich, Spessartweg 18; Erwin Goldschmidt, all of Hardheim, Fed. Rep. of Germany

[73] Assignees: Paul Eirich; Hubert Eirich; Walter Eirich, all of Hardeim, Fed. Rep. of Germany

[21] Appl. No.: 571,565

[22] Filed: Jan. 17, 1984

[30] Foreign Application Priority Data

Jan. 22, 1983 [DE] Fed. Rep. of Germany ..... 3302109

[51] Int. Cl.[4] ..... B01F 15/02

[52] U.S. Cl. ..... 366/188; 220/211; 220/244; 220/314; 366/192; 366/347

[58] Field of Search ..... 366/139, 39, 57–59, 366/54, 135, 187, 163, 188, 191, 192, 220, 225, 232, 233, 14, 30, 36, 347; 220/211, 244, 260, 314, 329, 337

[56] References Cited

U.S. PATENT DOCUMENTS 4,096,968 6/1978 Treiber et al. ..... 220/244

4,430,002 2/1984 Dongelmans ..... 220/211 X

FOREIGN PATENT DOCUMENTS 349158 2/1922 Fed. Rep. of Germany .

*Primary Examiner*—Timothy F. Simone

*Attorney, Agent, or Firm*—Dann, Dorfman, Herrell & Skillman

[57] ABSTRACT

Described is an apparatus for closing and continuously emptying the container of a processing machine by means of a closure cover (6–9) which is arranged in the bottom (1) of the container and which is driven so that it can be moved into and out of the emptying opening (2) in the bottom (1) of the container by way of a pivotal shaft (17) acting as a lifting means on a mounting means, for example a mounting arm (16), outside the container.

In order to permit both coarse and fine adjustment of the discharge rate in operation and also closure of the container, without incurring high levels of capital investment and also with robust operating characteristics, the invention provides that the closure cover (6–9) has a controllable rotary drive means (11, 14, 15), the pivotal shaft (17) acting as the lifting means is connected to a control drive means (21) for precise adjustment of the inclination of the mounting arm (16) and that the emptying opening (2) has a downwardly frustoconically flaring discharge hopper (4) into which the closure cover (6–9) can engage.

14 Claims, 4 Drawing Figures

Figure 1:
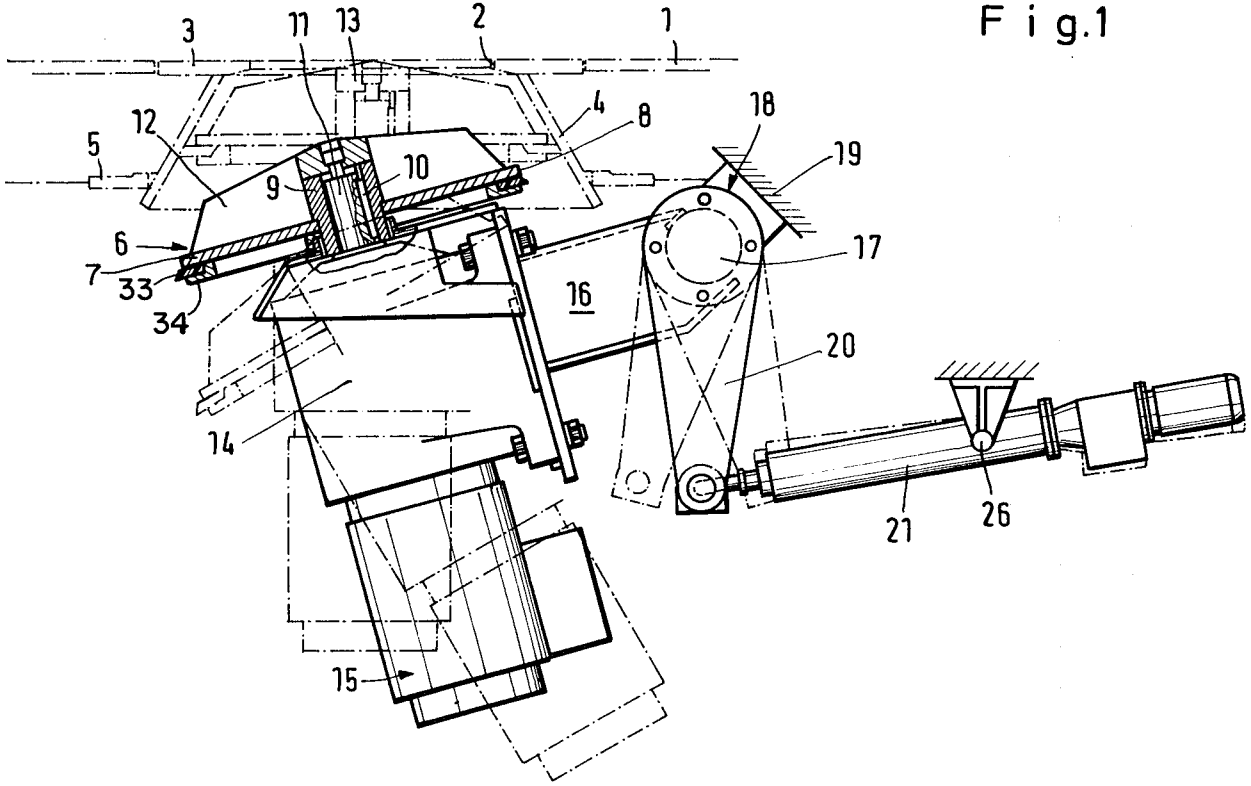

APPARATUS FOR CLOSING AND CONTINUOUSLY EMPTYING THE CONTAINER OF A TREATMENT MACHINE

The invention relates to an apparatus for closing and continuously emptying the container of a treatment or processing machine, by means of a closure cover which is disposed in the bottom of the container and which is driven so that it can be moved into and out of the emptying opening in the bottom of the container, by way of a lifting means, on a mounting outside the container.

A very wide range of types of processing or treatment machines are known, for example mixing machines with a stationary or a rotary mixing container and with a continuous discharge of mixed material.

In a known construction, the operation of emptying the mixing container is effected by means of a rotary hopper member which is cylindrical or which enlarges in a frustoconical configuration in a downward direction away from the bottom of the container, the hopper being secured to the emptying opening. Disposed below the hopper at a spacing therefrom is a conveyor means, for example a belt conveyor, a vibrator conveyor or a scraper conveyor. The intake of the conveyor is of such a configuration that the mixed material is retained and accumulates between the discharge hopper and the intake of the conveyor and that the effect of the back pressure resulting therefrom can be felt back into the mixer.

As the amount of material discharged is regulated by the regulated conveyor output of the conveyor disposed on the downstream side of the apparatus, various disadvantages are incurred. For example, the above-described known machines can only be used to process or treat materials which, when present in bulk, have characteristics such as to permit the above-mentioned build-up and back-pressure that are required. Another disadvantage is the expensive drive means, when using long conveyor systems, in particular the control drive means requiring high capital investment costs and not being maintenancefree, by virtue of the complicated modes of operation thereof. The known mixing container cannot be closed so that, at the beginning of the mixing operation, unmixed material is initially and unavoidably discharged, which is a disadvantage.

A mixing machine is also known which, below the discharge opening thereof, has a discharge hopper which flares downwardly in a frustoconical configuration. A plate-type feeder member is rotatably disposed below the discharge hopper, at a spacing therefrom. In operation of the arrangement, the space in the discharge hopper and above the plate-type feeder member is completely filled with mixed material which is carried away to at least one removal location by means of tongue members on the plate-type feeder which pull the material out to discharge it. Apart from the fact that the operation of this arrangement depends on the bulk characteristics of the materials to be processed thereby, the known mixing apparatus requires expensive encapsulation when dealing with materials in dust form, and involves high capital investment costs.

The object of the present invention is therefore to provide a closure apparatus of the kind set forth in the opening part of this specification, which, without involving high capital investment costs and while being of robust operating characteristics, permits both coarse and fine regulation of the discharge of the apparatus in operation, and also permits the container to be closed off.

According to the invention, that object is achieved in that the closure cover has a controllable rotary drive means, the lifting means is coupled to a control drive means for precise adjustment of the position of the mounting means, and that the emptying opening has a discharge hopper which flares outwardly and downwardly in a frustoconical configuration and into which the closure cover can be moved. The novel closure apparatus makes it possible for the container of the treatment machine or the emptying opening thereof to be completely closed at the beginning of operation of the arrangement, at the end of operation thereof, and possibly even at particular times during operation, for example in order to interrupt the emptying process or the discharge operation. However, at the same time, the novel closure apparatus makes it possible rapidly and accurately to attain an open condition or a width of opening so that treated material can be continuously discharged under the required quantitative control. Rapid adjustment is achieved by virtue of precise, rapid movement of the position of the mounting means, for example the position of a mounting arm, by means of the above-mentioned control drive means, thereby so-to-speak providing for coarse adjustment of the discharge capacity. In that way, the width of opening of the discharge or emptying aperture in the bottom of the container of the machine is adjusted. In that way it is possible rapidly and really accurately for example to adapt the machine to the respective grain size and the flow characteristics of the treated mixed material.

While the width of the discharge opening is adjusted by adjusting the position of the mounting means or mounting arm (coarse adjustment), fine adjustement is effected by means of the controllable rotary drive for the closure cover, about the axis of rotation which extends normal to the closure cover. That axis is disposed coaxially with respect to the drive shaft which projects out of a drive motor towards the closure cover. The connection between the closure cover and the drive shaft is made in the manner which is most appropriate from the point of view of the man skilled in the mechanical engineering art, for example by means of a groove and spline connection. Therefore, fine adjustment is effected by means of the controllable rotary drive means of the closure cover, which is controllable for example in dependence on the drive power of the processing machine.

By virtue of the closure member being able to move into the conically flared discharge hopper, it is possible inter alia to ensure a favourable flow of material, and the movement of the closure cover into the hopper may also be effected against the flow of material, in operation of the apparatus, at the end of the treatment process or for the purposes of adjusting the discharge rate.

In a further advantageous embodiment of the invention, the closure cover is provided with vane fitments on the top side of the closure cover, which is towards the discharge opening. The vane fitments may be of various configurations, for example, radial, curved arrays of scoop-like vanes are advantageous, while an embodiment of the vanes which is broad and low or, depending on the purpose thereof, narrower and/or high, may also be desirable. Preferably, the outside contour of the vane-like fitments is to be matched to the conically downwardly flaring discharge hopper. The vane fitments according to the invention can accommodate the drive means, in particular the rotary shaft in the centre of the plate member of the closure cover.

The control drive for adjusting the mounting arm may be electrical, pneumatic or hydraulic but the position of the closure cover may also be adjusted manually by means of a hand wheel. In that connection, it is desirable for an indicator means to be provided on the adjusting arrangement in such a way that the position of the mounting arm is immediately visible to the operator, irrespective of the nature of the adjusting drive means.

It is also advantageous in accordance with the invention for a freewheel means and/or a resilient mounting means to be installed between the control drive means and the closure cover. The closure apparatus according to the invention can be used both for stationary and for rotary containers in processing or treatment machines. The freewheel means is particularly desirable when the machine is a positive-action mixer having a rotary container. In that case, the closure cover may also move into the rotating container or the discharge opening thereof, and is entrained thereby at the beginning of the closure condition.

Conversely, when the apparatus is used in stationary containers, the movement of the closure plate member on the one hand and the bottom of the container on the other hand may be matched by means of the correspondingly provided control action of the control drive means so that the drive means of the closure cover is stopped in the closed position.

While, in a first preferred embodiment, the lifting means may be a pivotal shaft which is connected to a mounting arm so that the controllable rotary drive means permits precise setting of the inclination of the mounting arm, in another embodiment, in accordance with the invention, the closure cover may be movably adjustable in a direction normal to the bottom of the container. That vertical component of movement can be produced by means of a hydraulic cylinder unit which is desirably mounted to a stationary discharge pipe. A hydraulic motor is desirably mounted by means of flanges to the piston rod of the hydraulic cylinder unit, the output shaft of the hydraulic motor carrying the closure cover.

If, in another advantageous embodiment of the invention, the closure cover is provided with a seal at its outer periphery, the closure cover can even be moved into a fluid-tight sealing position in the discharge opening in the bottom of the container.

If the closure cover is adapted to be heated, then it is also possible advantageously to deal with hot mixtures and/or sticky or adhesive materials to be processed.

In another advantageous embodiment of the invention, the rotary speed control means is electrical, hydraulic or mechanical. For example, the speed of rotation of the cover may be regulated electrically by means of a d.c. motor, hydraulically by means of an adjustable hydraulic motor or mechanically by means of a controllable drive transmission. It is also desirable for the speed of rotation to be controllable in a load-dependent manner, on the power consumption or power input of the drive motor or motors of the machine.

For dealing with particularly sticky or adhesive products, in accordance with the invention, it is also possible for the rotary discharge hopper and/or the closure cover to be provided with a stationary scraper member. In that connection, in the case of the cosure cover, it is preferable for the closure cover not to be provided with the above-mentioned vane fitments or the like, but to have a smooth surface. Although, when scraper members are fitted, the closure cover may only be moved into the discharge hopper to such an extent that there is still a gap that remains free, which corresponds to the thickness of the scraper member or members, and the opening cannot therefore be completely closed, that is generally not harmful when dealing with sticky material which first makes it necessary to use scraper members.

It will be seen that the novel closure apparatus provides for improved operation for closure of the machine at any time and the continuous discharge of processed materials. The discharge arrangement may also be operated by an automatic control means in such a way that, if the required discharge amount of material is not attained and/or the upper and lower speed limits of the rotary drive means for the closure cover are reached, the width of the discharge opening is automatically adjusted, for example by a pivotal movement of the mounting arm.

Although closure apparatuses with closure covers on mounting arms are already known per se, the above-mentioned options cannot be achieved with the known closure apparatuses, especially as the design configuration thereof is directed to specific mounting means features.

Figure 2:
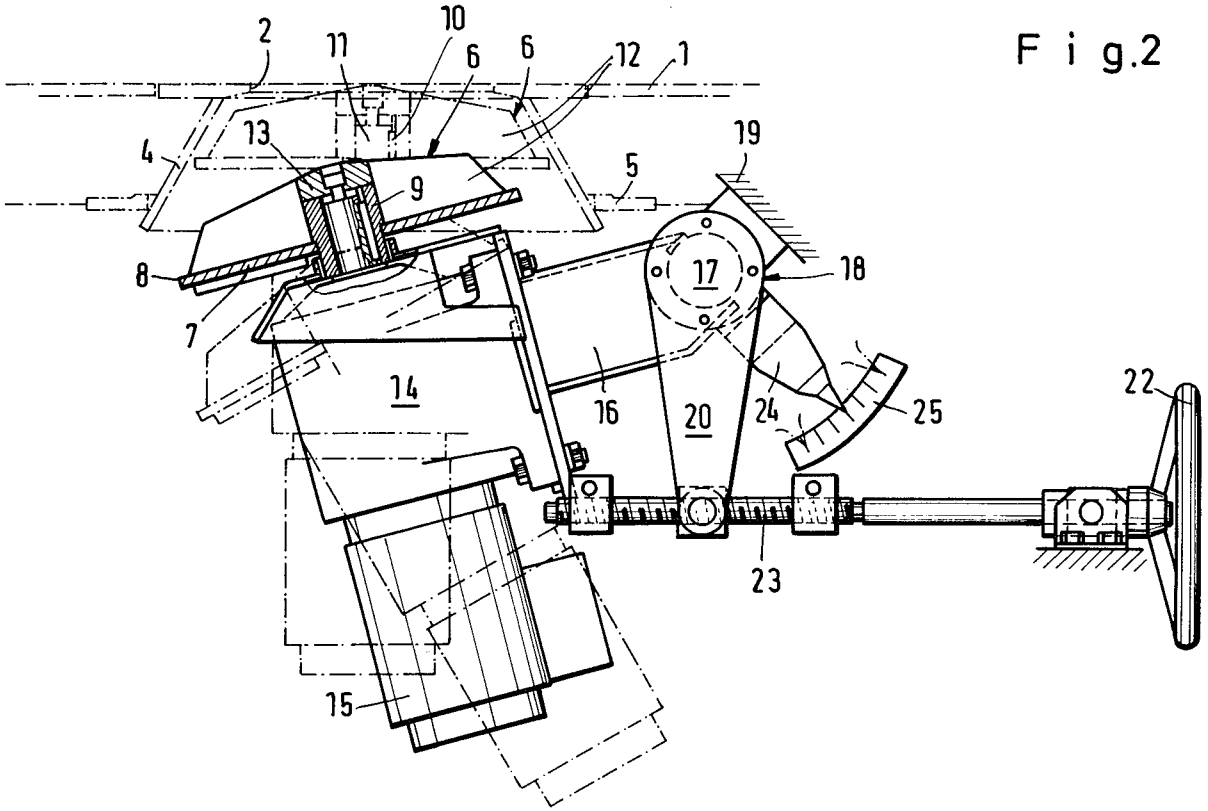
Figure 3:
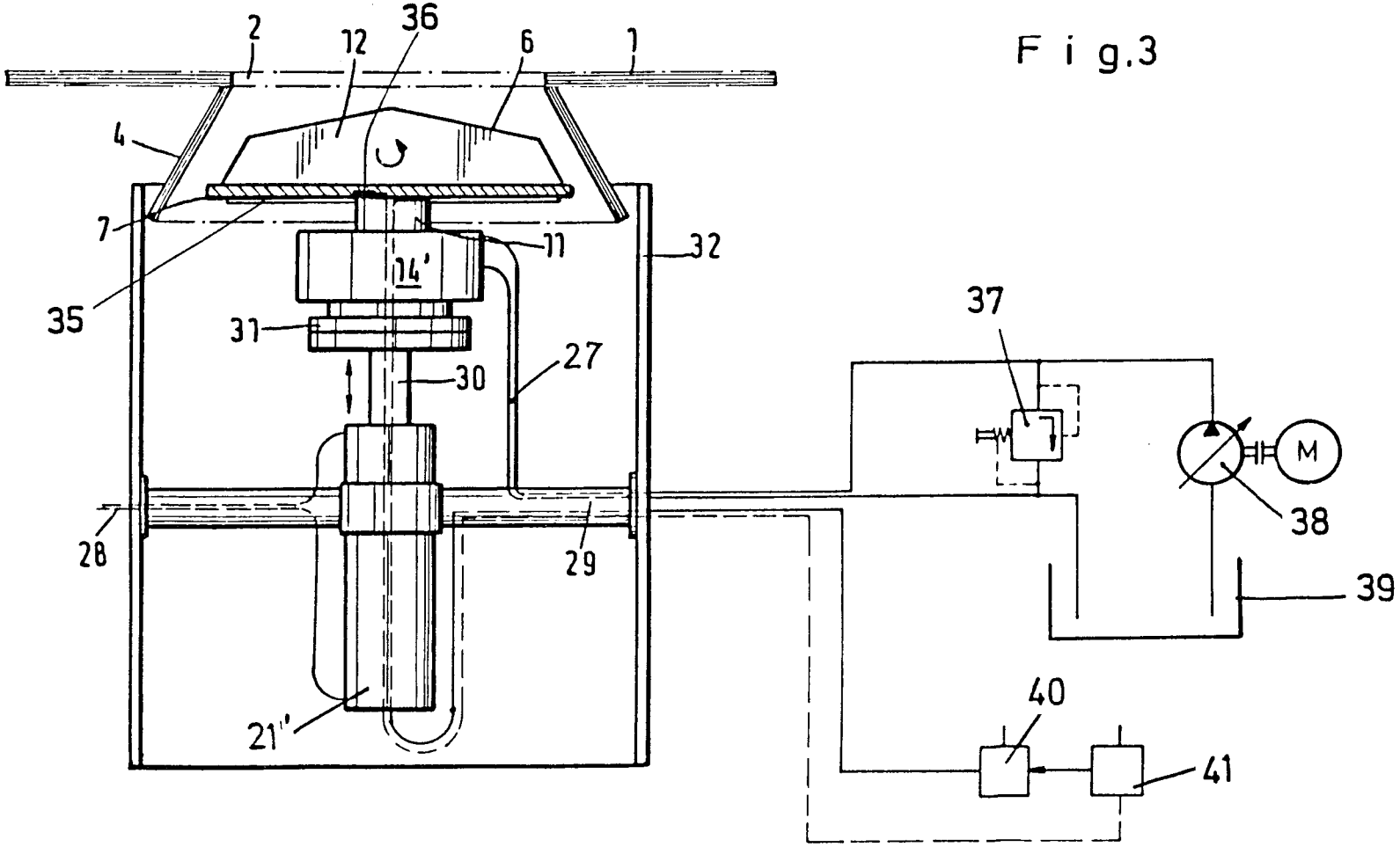
Figure 4:
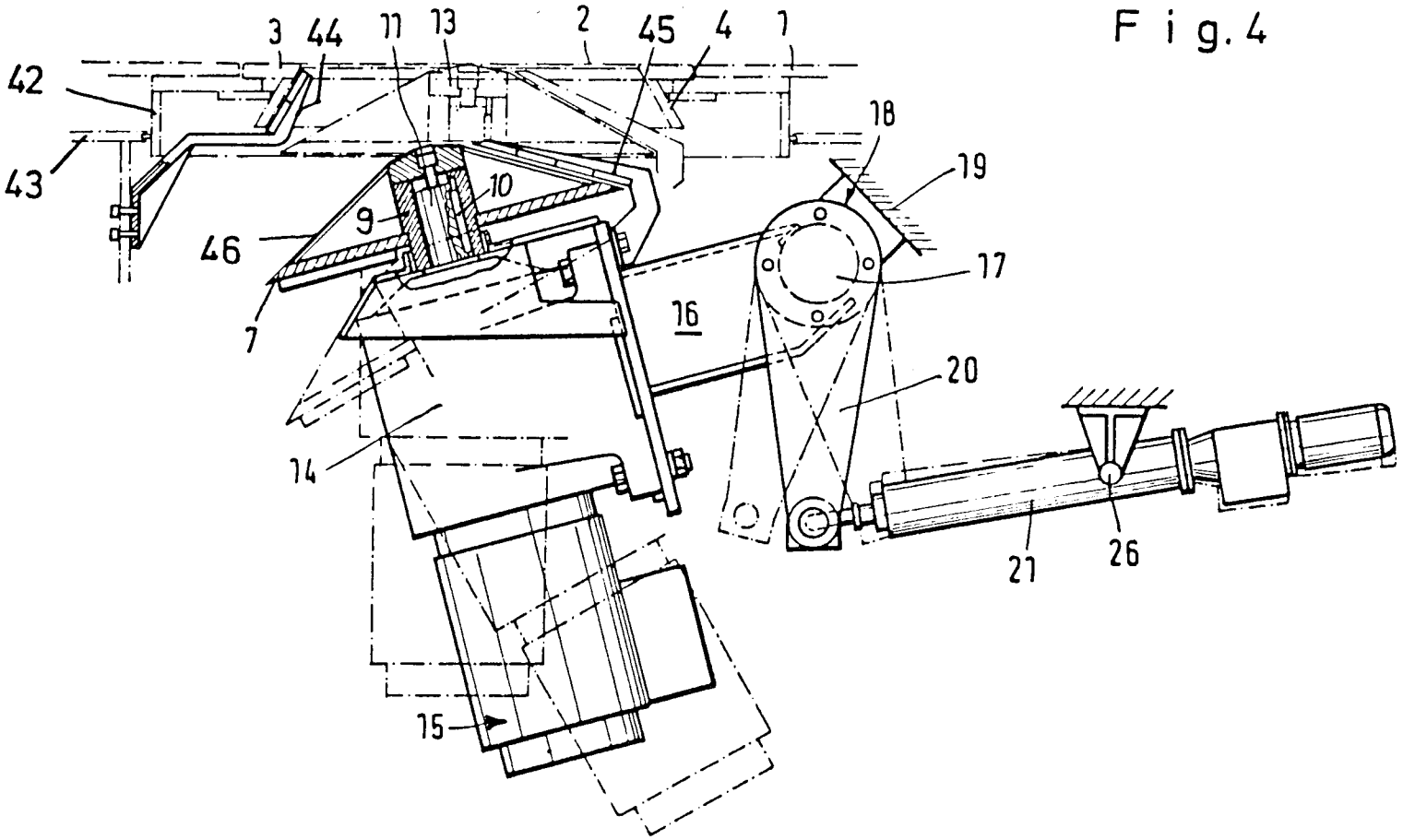

Further advantages, features and possible uses of the present invention will be apparent from the following description of three preferred embodiments with reference to the accompanying drawings in which:

FIG. 1 is a diagrammatic side view of a closure apparatus according to the invention, with an electric rotary drive means for adjusting the angle of inclination of the mounting arm, FIG. 2 shows a similar view to that shown in FIG. 1 in which however the drive for adjusting the inclination of the mounting arm is produced by means of a hand spindle and the inclination indicator is shown, FIG. 3 shows a similar view to that shown in FIGS. 1 and 2 of another embodiment with vertical adjustability of the closure cover and FIG. 4 shows a similar view to that shown in FIG. 1 in which stationary scrapers are provided for the discharge hopper and the closure cover.

In FIGS. 1 and 2, many parts of the closure apparatus according to the invention are the same, and are therefore denoted by the same reference numerals. The bottom 1 of the container (not shown) of a processing or treatment machine is shown in broken-away form by dash-dotted lines in the top left region of the drawing. The discharge or emptying opening 2 is disposed in the centre of the bottom of the container. The opening 2 is surrounded by a ring 3 which is flush with the bottom 1 of the container; the frustoconically flaring discharge hopper 4 is mounted on the ring 3, in a downward direction therefrom. The rotary discharge hopper 4 is supported by a further mounting ring 5 in its other lower region, the fixing thereof only being indicated by a dash-dotted line, and not being important from the point of view of comprehension of the invention.

The closure cover itself is generally denoted by reference numeral 6. In this embodiment, it comprises a circular plate member 7 carrying a sealing ring 33 supported in a supporting 34 to provide a seal at its outer periphery 8. Disposed in the centre of the round plate member 7 is a sleeve 9 which is secured to the plate member 7 and which forms a connection to the drive shaft 11 by way of the spline 10, with the groove (not shown). Vane-like attachments 12 are mounted on the outside of the sleeve member 9 and on the top of the plate member 7. In the embodiments illustrated in the drawings, the vane fitments 12 are thin plates in the form of scoops or impeller members which extend radially in a straight line. At the top, the thin plates are joined together by way of a hub portion 13, forming a star-shaped ancilliary discharge unit.

The drive shaft 11 is disposed on the output side of a transmission 14, the electric motor 15 being joined to the input side thereof by a flange connection. The electric motor 15 is carried, by way of the transmission unit 14, by the mounting arm 16 which is securred to the pivotal shaft 17 which is supported on the frame structure 19 (shown in diagrammatic form), by way of a mounting means generally indicated by reference numeral 18.

The pivotal drive means also has a pivotal lever 20 which is rigidly connected to the shaft 17 and which, in the embodiment illustrated in FIG. 1, is moved by way of the control drive means which is in the form of an electrically actuated adjusting device 21.

Unlike FIG. 1, the control drive means in the embodiment shown in FIG. 2 is a spindle 23 which can be driven in rotation by means of a hand wheel 22 and which produces pivotal movement of the pivotal lever 20 in the manner clearly shown in FIG. 2.

A pointer 24 is also secured to the shaft 17. The pointer 24 makes it possible at any time to ascertain the precise angle of inclination of the mounting arm 16, by means of a scale 25.

The mode of operation of the closure apparatus is such that, in the embodiment shown in FIG. 1, the closure cover 6 is pivoted out of the discharge opening 2 in a downward direction. Shortly after leaving the closed position, the circular plate member 7 is still almost in the same plane as the bottom 1 of the container, as shown in dash-dotted lines in both the embodiments shown in FIGS. 1 and 2. The electrical adjusting device 21 which itself is mounted tiltably about a mounting member 26 pivots the mounting arm 16 to alter the angle of inclination thereof, by way of the various positions of the pivotal lever 20 and the shaft 17, so as to produce an intermediate condition which is shown in solid lines in both of FIGS. 1 and 2. Further retraction of the pivotal lever 20 in the anti-clockwise direction then permits the arrangement to move into the lower position of the closure cover 6, as shown in dash-dotted lines.

It will also be seen from the drawings that coarse adjustment can be effected by virtue of the different angles of inclination of the mounting arm 16, and it can be readily envisaged from the foregoing description, how rotary movement of the round plate 7, that is to say, the closure cover 6, permits fine adjustment of the discharge flow rate of the processed material. In this respect, with the closure cover 7 rotating about the shaft 11, the vane-like fitments 12 virtually scoop the processed material on to a removal station (not shown) so that the discharge flow from the container does not depend on the removal station or the conveyor system at that point, but depends on the speed of rotation of the motor 15 and the position of the mounting arm 16.

In the embodiment shown in FIG. 3, the closure cover 6 is mounted on the output end of the drive shaft 11 of the hydraulic motor 14'. The closure cover may be heated by a heating member 35 energized in response to a temperature sensor 36, temperature indicator 41 and heating regulator 40. The hydraulic motor 14' is connected by way of flanges 31 to the piston rod 30 of a hydraulic cylinder unit 21'.

The hydraulic cylinder unit 21' is secured to a stationary discharge pipe 32 by means of two mounting bars 29.

The mounting means can also be utilised in order to take the supply lines 27 of the hydraulic motor 14' and 28 for the hydraulic cylinder unit 21' to the exterior. Both the hydraulic installation for the lifting movement and also that for the rotary drive of the cover include, outside the illustrated apparatus, the appropriate ancilliary equipment such as pumps, valves, flow rate controllers and the like.

Under the assumption that the regulation of the rotational speed is provided hydraulically, and is dependent on the load and the power consumption of the driving motors M of the machine respectively, one can recognize in the middle part at the right hand side in FIG. 3 a pressure relief valve 37 in the output circuit of the regulating hydraulic pump 38, the inlet conduit of which terminates in the oil sump 39 (shown without liquid).

In the treatment of especially sticky masses it is suitable to keep the discharge gap of the cover open by inserting corresponding scrapers. In FIG. 4 of the drawings, the rotary discharge hopper 4 is provided with a stationary scraper 44 (left position) and the cover of the rotary closure plate 7 is provided with a stationary scraper 45 (right hand position). The closure cover according to FIG. 4 comprises a rotating frustocone with smooth surface 46. The assembly of the left scraper 44 is shown above the basic frame 43 to which the end ring 42 is abutting. The remaining components are given the same reference numerals as the corresponding parts in FIG. 1.

Mounting of these scrapers 44 and 45 necessarily has the consequence that the cover with these sticky materials cannot be closed entirely but just up to a certain clearance width, which width corresponds to the width of the scrapers 44 and 45. Using these stationary scrapers 44 and 45, the plastic and sticky substances do not discharge, in spite of the resulting clearance opening with the machine arrested, because the substances form a very steep angle of repose or discharge cone.

It will be appreciated that the embodiments illustrated in FIGS. 1 through 4 also include all monitoring and signalling devices for transmitting the speed of rotation of the cover and the position of the cover to a suitable control arrangement.

We claim:

1. Apparatus for closing and continously controlling the emptying of material from the container of a processing machine having a bottom with an emptying opening therein, comprising a closure cover, mounting means outside the container opening to mount the cover for rotation about an axis adjacent the bottom of the container, lifting means to displace said cover so that it can be moved into and out of the emptying opening, a rotary drive means connected to said cover to rotate it about said axis and having a separately-controlled rotary speed control to control the flow of material through the opening a control drive means coupled to the lifting means for precise adjustment of the position of the mounting means to control the position of the cover relative to said opening, and a discharge hopper which flares outwardly from said opening in a frustoconical configuration so as to surround the closure cover, the displacement of said cover varying the clearance between the outer periphery of the cover and the inside of the hopper.

2. Apparatus as set forth in claim 1 wherein the closure cover is provided with vane attachments on its top side which is towards the emptying opening.

3. Apparatus as set forth in claim 1 including a freewheel means connecting the control drive means and the closure cover.

4. Apparatus as set forth in claim 1 wherein the lifting means adjustably displaces the closure cover in a direction normal to the bottom of the container.

5. Apparatus as set forth in claim 1 including a seal at the outer periphery of the closure.

6. Apparatus as set forth in claim 1 including heater means associated with the closure cover.

7. Apparatus as set forth in claim 1 characterized in that the rotary speed control is electrical.

8. Apparatus as set forth in claim 1 characterized in that the rotary speed control is dependent on load on the input power of the drive motors of the processing machine.

9. Apparatus as set forth in claim 1 including a stationary scraper mounted to engage the discharge hopper.

10. Apparatus as set forth in claim 1 including a resilient mounting means connecting the control drive means and the closure cover.

11. Apparatus as set forth in claim 1 characterized in that the rotary speed control is hydraulic.

12. Apparatus as set forth in claim 1 characterized in that the rotary speed control is mechanical.

13. Apparatus as set forth in claim 1 including a stationary scraper mounted to engage the closure cover.

14. Apparatus as set forth in claim 1 wherein said cover is generally coaxial with frustoconical hopper, and said lifting means displaces said cover generally axially within said hopper.

* * * * *